US005207807A

United States Patent [19]

Manfré et al.

[11] Patent Number: 5,207,807

[45] Date of Patent: May 4, 1993

[54] REGENERABLE FILTER FOR EXHAUST GASES OF AN INTERNAL-COMBUSTION ENGINE

[75] Inventors: Giovanni Manfré, Vinovo; Angelo Giachello; Francesco Cuniberti, both of Turin, all of Italy

[73] Assignee: Iveco Fiat S.p.A., Turin, Italy

[21] Appl. No.: 800,879

[22] Filed: Nov. 27, 1991

Related U.S. Application Data

[63] Continuation of Ser. No. 128,327, Dec. 3, 1987, abandoned.

[30] Foreign Application Priority Data

Dec. 5, 1986 [IT] Italy ..... 67909 A/86

[51] Int. Cl.[5] ..... B01D 46/04

[52] U.S. Cl. ..... 55/269; 55/283; 55/523; 55/524; 55/DIG. 30

[58] Field of Search ..... 55/208, 213, 269, 283, 55/466, 523, 524, 527, DIG. 30; 60/286, 303, 311

[56] References Cited

U.S. PATENT DOCUMENTS

| | | | |
|---|---|---|---|
| 3,018,841 | 1/1962 | Gerlich | 60/311 X |
| 3,889,464 | 6/1975 | Gardner | 60/286 |
| 3,937,015 | 2/1976 | Akado . | |
| 4,276,066 | 6/1981 | Bly . | |
| 4,376,637 | 3/1983 | Yang | 55/DIG. 30 X |
| 4,427,418 | 1/1984 | Koaiso . | |
| 4,455,823 | 6/1984 | Bly . | |
| 4,456,457 | 6/1984 | Nozawa et al. | 55/283 |
| 4,503,672 | 3/1985 | Stark . | |
| 4,505,107 | 3/1985 | Yamaguchi et al. | 60/303 |
| 4,505,726 | 3/1985 | Takeuchi . | |
| 4,516,993 | 5/1985 | Takeuchi . | |
| 4,535,589 | 8/1985 | Yoshida et al. | 60/303 |
| 4,599,095 | 7/1986 | Barnes et al. | 55/208 |
| 4,687,579 | 8/1987 | Bergman | 55/523 X |

*Primary Examiner*—Charles Hart

*Attorney, Agent, or Firm*—Kane, Dalsimer, Sullivan, Kurucz, Levy, Eisele and Richard

[57] ABSTRACT

The filter comprises filtering means suited to intercept the residual combustion products, and heating means suited to bring said residues to a combustion temperature; the heating means comprise a plurality of electrically conductive portions of said filtering means, mutually insulated and cyclically and selectively supplied.

20 Claims, 4 Drawing Sheets

REGENERABLE FILTER FOR EXHAUST GASES OF AN INTERNAL-COMBUSTION ENGINE

This is a continuation of copending application Ser. No. 07/128,327 filed on Dec. 3, 1987 now abandoned.

BACKGROUND OF THE INVENTION

This invention relates to a regenerable filter for the exhaust gases of an internal-combustion engine. In particular, this invention relates to a filter suited to be placed into an exhaust pipe of an internal-combustion engine, comprising a filtering member suited to intercept the residual combustion products contained in the exhaust gases and further comprising means suited to produce the combustion of said residues.

Filters are known in which said means suited to produce the combustion of the residues are of the kind that uses a catalyst for the starting of the combustion at low temperatures, or of the kind that heats the exhaust gases, upstream of the filtering member, to the combustion temperature of said residues.

Said filters suffer from certain drawbacks.

In the case of the entirely catalytic filters, it is not uncommon the so-called "poisoning" of the catalyst, due to the presence in the exhaust gases of chemicals that impair their catalytic activity to the point of completely discontinue the combustion of the residues; this originates a gradual clogging of the filter, with the resulting attainement of an unacceptable back-pressure on the engine exhaust.

In the case of heating filters, the heating of the exhaust gases usually takes place by means of resistive elements positioned upstream of the filtering member, which, supplied with an electric current, generate thermal power through Joule effect and rise the temperature of the gases that affect then the filtering surface. This solution entails a high consumption of electric power, with the risk of extreme charge losses of the vehicle battery.

A further drawback of the known heating filters is the fact that the filter temperature can increase exceedingly, since the regeneration usually takes place upon rather wide surfaces and so in a scarcely controlled manner; as a result there is the possibility of serious damages or the destruction due to exaggerated heatings.

For the double object of limiting the average temperature of the filter and reducing the electric power used, filters have been realized in which the filtering member is cyclically heated in relation with consecutive portions; the continuity of the filtering member nevertheless can allow the starting of wide and intense combustions. Furthermore, since in the known filters of this kind the heating of the consecutive portions of the filtering member is obtained through convection and radiation, the electric power overall supplied, is always substantially higher than the equivalent of the thermal power actually needed to locally start the combustion of the residues.

Solutions in which diesel oil or other fuel burners in substitution for said resistive elements are used, are also known; said solutions have however high costs and dimensions together with said problems connected with the regeneration.

SUMMARY OF THE INVENTION

An object of the present invention is to realize a regenerable filter for the exhaust gases of an internal-combustion engine, that lacks in the drawbacks connected with the above-mentioned and known filters, and is particularly simple, practical, and removes the risks of clogging or self-destruction due to exaggerated heating.

Said object is attained by the present invention in that it relates to a regenerable filter for the exhaust gases of an internal-combustion engine, of the kind comprising:

an outer casing provided with at least an inlet duct and at least an outlet duct, suited to be placed in series with an exhaust pipe of said engine;

filtering means housed into said outer casing and suited to intercept the residual combustion products contained in said exhaust gases; and heating means suited to bring the residual combustion products to a temperature sufficient to originate the combustion;

characterized in that said filtering means comprise a plurality of portions at least partially realized from an electrically conductive material and forming said heating means; said portions being mutually insulated and electrically supplied in a selective and cyclic manner.

BRIEF DESCRIPTION OF THE DRAWINGS

For a better understanding of the present invention, some preferred embodiments are described below, as a non limiting example and referring to the accompanying drawings, in which.

DETAILED DESCRIPTION OF THE INVENTION

Figure 1:
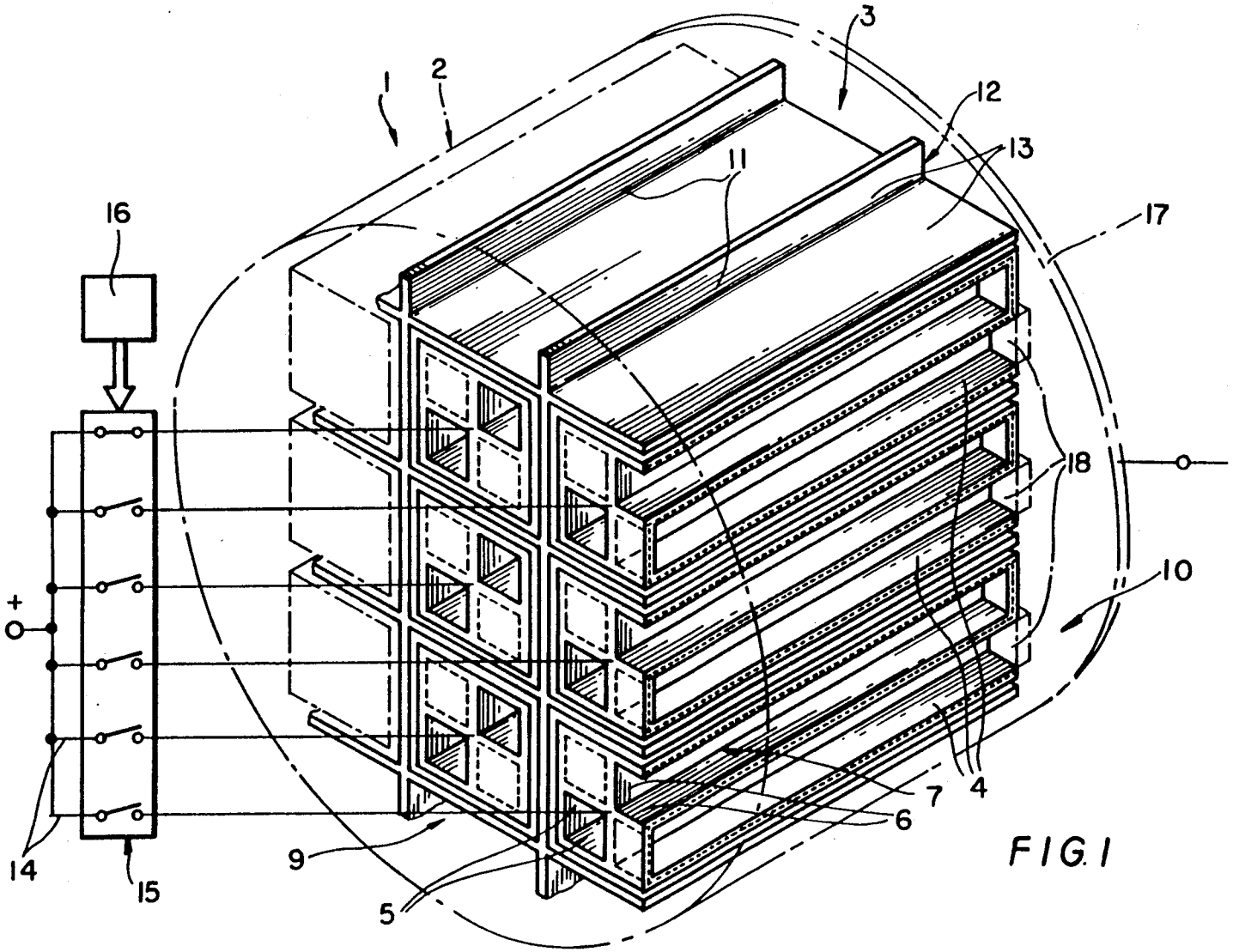
FIG. 1 is a perspective view of a first embodiment of a regenerable filter according to the present invention.
Figure 2:
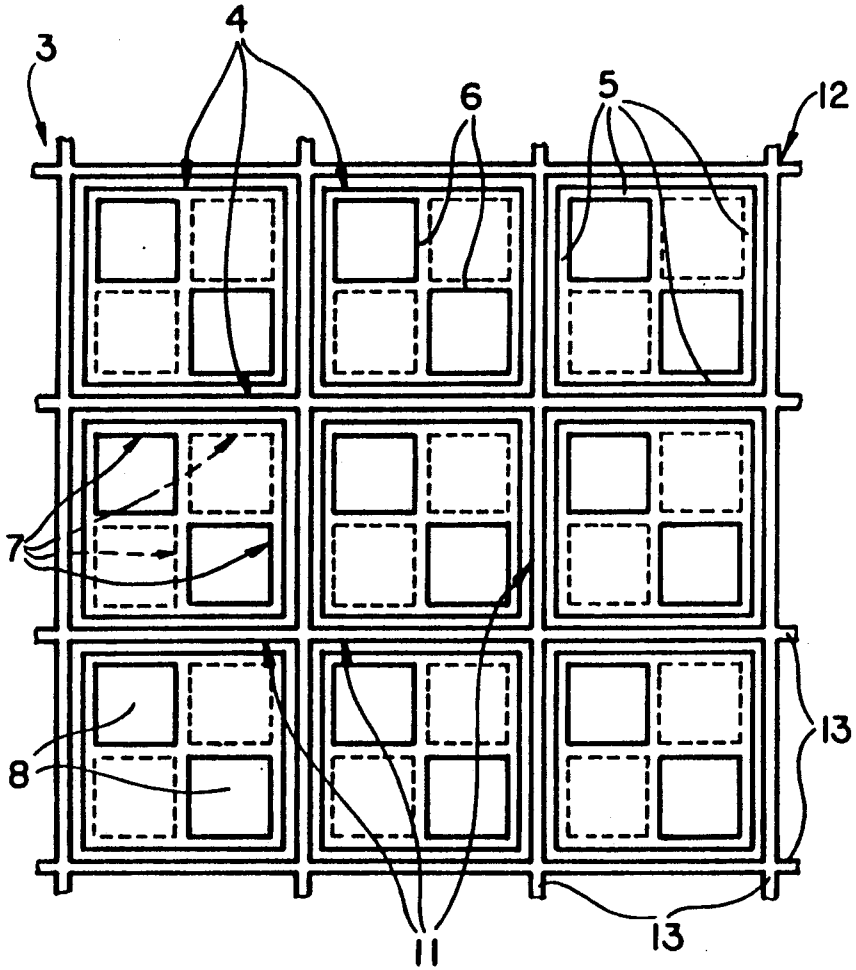
FIG. 2 is a front view, partial and in enlarged scale of a detail of FIG. 1.

Referring in particular to FIGS. 1 and 2, it is designated generally by 1 a regenerable filter for an internal-combustion engine, in particular of the compression-ignition type.

The filter 1 comprises a cylindric outer casing 2, schematically shown in dotted line in FIG. 1, and a filtering member 3 housed into said casing 2.

The filtering member 3 comprises a plurality of honey-comb cells 4, suitably obtained from a porous and electrically conductive material, for instance of the ceramic type. Each cell 4, having an elongate prismatic shape with square section, comprises four side walls 5 and two inner division walls 6, mutually orthogonal and located along the middle planes of the cell 4, so as to define four square section cavities 7. Cavities 7 are closed at one end by a front wall 8, and open at the opposite end; in particular, two diagonally opposed cavities 7 of each cell 4 are open at one end 9, the other two cavities of the same cell 4 being open at an opposite end 10.

According to the present invention, each cell 4 is arranged into a corresponding seat 11 of a reticulated structure 12, realized in an electrically and thermally insulating material, defined by two orders of flat, parallel and equidistant walls 13, perpendicularly intersecting one another.

Cells 4 are connected at one end 9 by means of respective electric cables 14, to the positive pole of the vehicle battery; said connection is subject to the action of interruption means 15, for instance controlled diodes, controlled by a conventional control exchange 16. The opposite ends 10 of cells 4 are connected to a metal plate 17 of the casing 2, which is provided with apertures 18 facing corresponding apertures of the cells 4 themselves, and is in electric connection with a negative pole of the vehicle battery.

Figure 4:
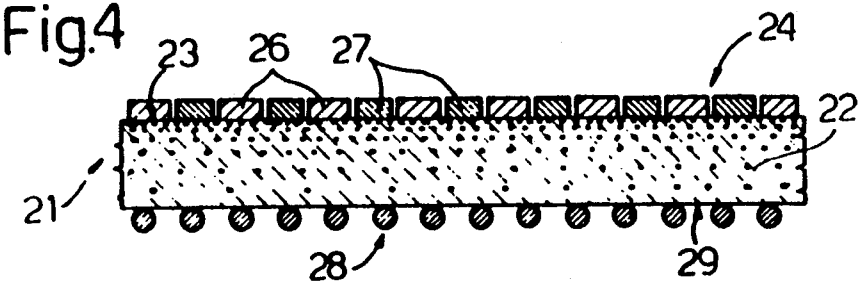
FIG. 4 is a partial cross-section and in enlarged scale of the filter of FIG. 3.
Figure 3:
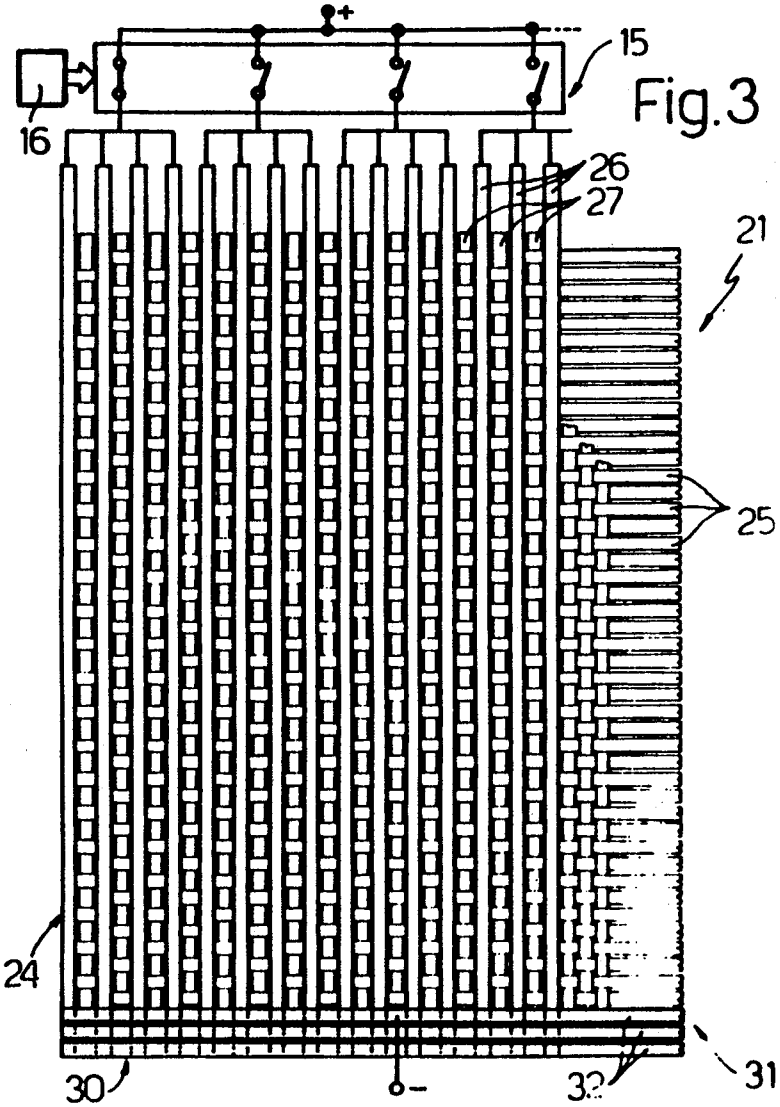
FIG. 3 is an elevation and partial view of a second embodiment of a regenerable filter according to the present invention.

In FIGS. 3 and 4, is designated by 21 a portion of a filtering member realized in electrically conductive fabric. In particular, fabric 21 comprises an intervening layer 22, forming the actual filtering member, suitably obtained from non-conducting ceramic fibers having a substantial heat-resistance. Upon a surface 23 of the intervening layer 22, facing in use the inflow of the exhaust gases, a second fabric layer 24 is arranged, formed by bundles 25 of microthreads (afterwards named shortly "threads") in non-conductive ceramic fibre, arranged longitudinally, and by conductive threads 26 alternate with non-conductive threads 27 arranged transversally. Conductive threads 26 are suitably produced from metallic materials (for instance stainless steel, Ni-Cr or other alloys) or conductive ceramics (for instance SiC), resistant to high temperatures, or ceramics plated with oxidation-resistant metals. The fabric 21 further comprises a layer 28 having the role of simple support, applied on the opposite surface 29 of the intervening layer 23.

Conductive threads 26 are connected adjacent an edge 30 of the fabric 21 to an electrode 31 formed by a plurality of metal foils 32 arranged perpendicularly to the threads 26 and in turn connected to a pole of the battery of the vehicle or directly to the alternator; the conductive threads 26 are connected in groups, at an opposite end, to another pole of the vehicle battery, through a control device similar to that described with reference to FIG. 1.

Figure 5:
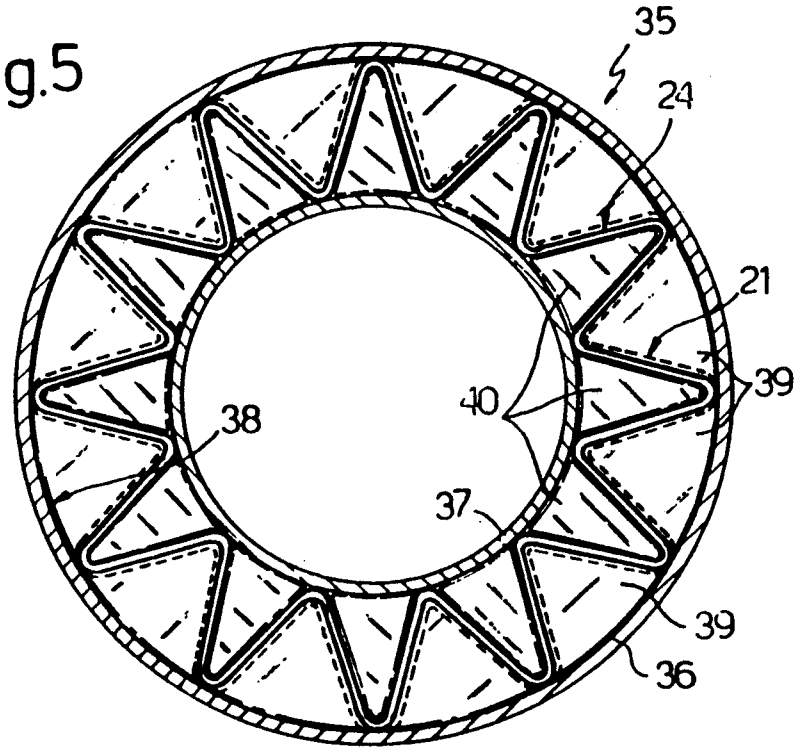
FIG. 5 illustrates a cross-section of a particular arrangement of the filter of FIG. 3.

In FIG. 5, an example of an embodiment of a filter 35 using the fabric 21 of the kind described is shown. Filter 35 comprises an outer casing formed by two coaxial tubular bodies 36, 37, defining an annular chamber 38 inbetween. The fabric 21, the surface provided with the conductive layer 24 of which is shown in phantom, is arranged into the annular chamber 38 substantially according to a closed polygonal line, the corners of which, angularly equidistant, are alternately joined to the tubular bodies 36 and 37. The fabric 21 forms with the tubular body 36 and with the tubular body 37, a plurality of spaces 39, 40, respectively communicating, in a not shown way, with an inlet aperture and with an outlet aperture of filter 35.

Figure 6:
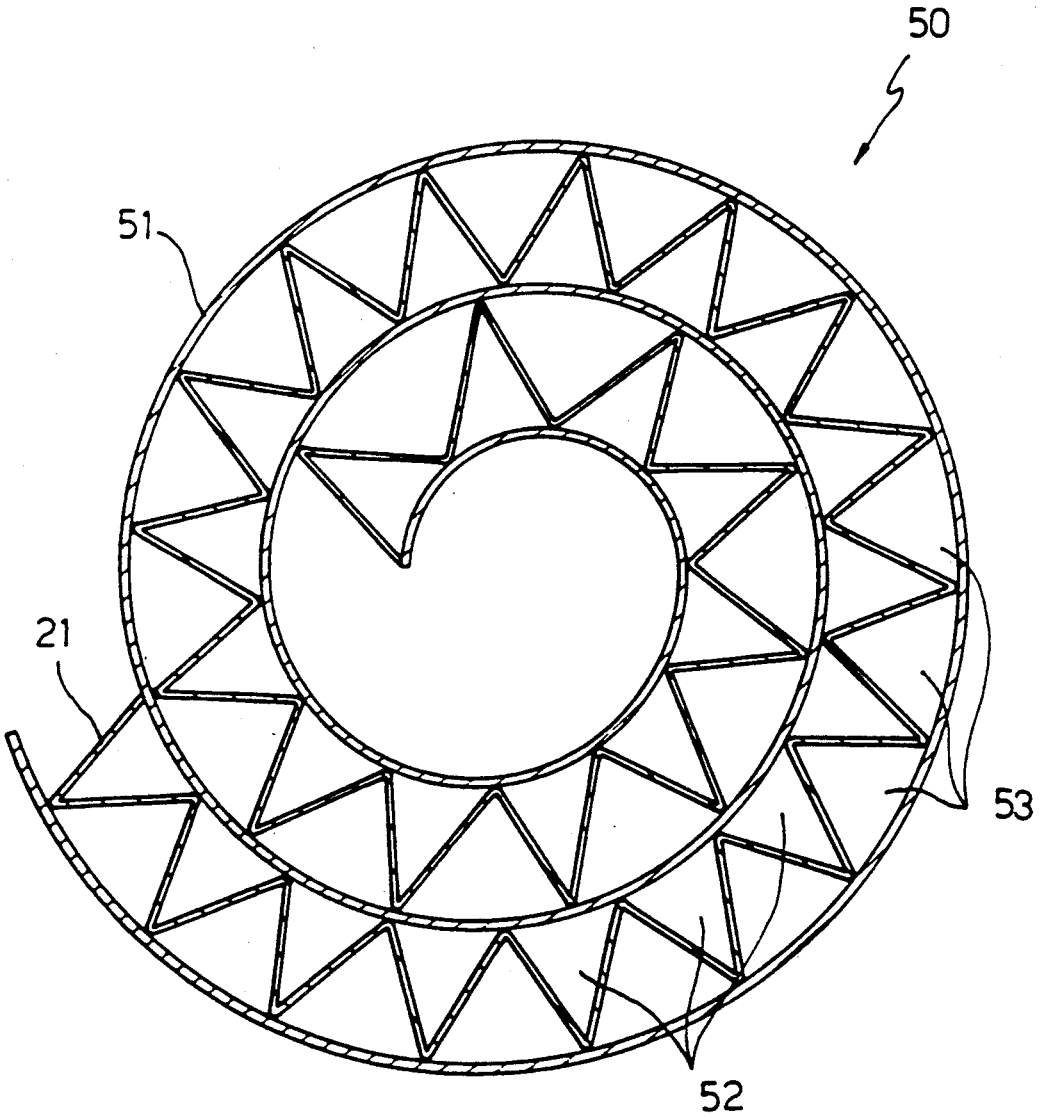
FIG. 6 is a cross-section of a third embodiment of a filter according to the present invention.

In FIG. 6 a second example of an embodiment of a filter 50 using the fabric 21 of the kind described is partially illustrated. The fabric 21 is pleated and is fixed on a support layer 51 spiral wound into a not shown cylindric casing. The fabric 21 forms with the support layer 51 a plurality of spaces 52, 53 respectively communicating, in a not shown way, with an inlet aperture and with an outlet aperture of filter 50.

Figure 7:
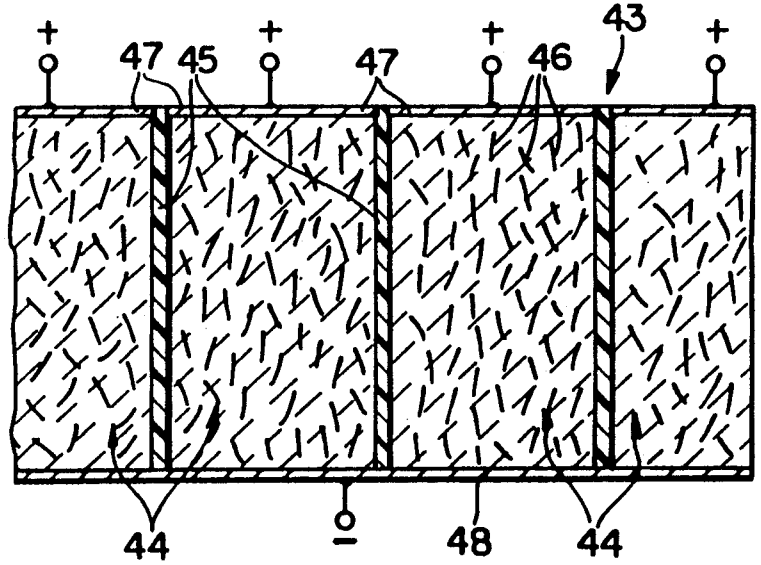
FIG. 7 is a partial cross-section of a filtering member of a further embodiment according to the present invention.

In FIG. 7, a further embodiment of the conductive fabric is illustrated. The fabric 43 is subdivided in a plurality of portions 44, separated one another by insulating elements 45, formed for instance by strips of fabric from non conductive and oxidation resistant ceramic fibres. Portions 44 are realized from non conductive fibres, into which conductive fibres 46 schematically shown in phantom and arranged at random are incorporated. The fabric 43 has at an edge a plurality of electrodes 47, for instance metal foils, insulated each other by the elements 45 and apt to be connected through a control device of the kind described to a pole of the vehicle battery; fabric 43 further has, at an opposite edge, a further electrode 48 connecting portions 45 to the other pole of the battery.

The operation of the filter is as follows.

The exhaust gases emitted by the engine are conveyed in a know manner into the casing 2 of the filter 1 and enter in the cavities 7 open on the side of the end 9. Since these cavities are closed at the opposite end by the front walls 8, gases are constrained to pass through the walls 6, which intercept the residual combustion products, in order to go in the adjacent cavities 7 which are open on the side of the end 10 and allow the discharge of gases from filter 1 through the apertures 18 of the plate 17. The build-up of residues in the walls 6 originates a gradual clogging of the filter, creating a back-pressure in the engine exhaust. The control exchange 16, as a result of a signal received, for instance, from a pressure sensor detecting the pressure difference of the exhaust gas between inlet and outlet from the filter 1, causes the closing of one of the switches 15. Consequently one of the cells 4 is electrically supplied through the circuit formed by the respective cable 14, the cell 4 and the plate 17. The flow of electric current through the walls 5 and 6 of the cell 4 gives rise to a heating by Joule effect of the walls till the combustion temperature of the residues is attained, which are oxidized and gassified freeing the porosity of the cell.

Subsequently, the control exchange 16 disconnects the supply to the cell 4 and supplies the subsequent cell 4. All the cells are supplied in sequence, according to an order and for a time predetermined or governed from time to time by the control exchange 16. For instance, the exchange 16 can control the intensity of current and the heating time of each cell 4 as a function of the revolutions of the engine and of the rate of flow of the air passing through the filter 1 by the action of an appropriate device, for instance a fan or a positive-displacement pump.

The operation of filter 35 is similar; in this case, the filtering and heating function is assigned to the fabric 21. The exhaust gases (FIG. 5) enter the filter 35 through an inlet aperture, not illustrated, and enter the spaces 39 included between the outer tubular body 36 and the fabric 21. The gases pass then through the fabric 21, which intercepts the residual combustion products, and enter the spaces 40 included between said fabric 21 and the inner tubular body 37, from which they exit through a not shown outlet aperture.

As relates the filter 50 (FIG. 6), the exhaust gases enter through an inlet aperture, not illustrated, and enter the spaces 52; they pass then through the fabric 21, that intercepts the residual combustion products, and enter the spaces 53 from which they exit through a not shown outlet aperture.

The conductive threads 26 of the fabric 21 can be supplied by groups according to a predetermined program, so as to assure in use the combustion of the residues accumulated in a well defined portion of the fabric 21; while this portion is regenerated, the residues build-up in other portions of the fabric 21, which will be regenerated in sequence. At the end of the regeneration of the last portion, the cycle starts again with the regeneration of the first regenerated portion, which in the meantime will have intercepted new residues.

It should be noted, in particular, that the "meshes" of the conductive layer 24 are suitably wide enough to allow the passage of the residues, that are intercepted, as schematically illustrated in FIG. 4, by the filtering layer 22. The concentration of the residues results substantially distributed around the conductors 26, which provide for the heating by direct conduction of those residues.

In the fabric 43 illustrated in FIG. 7, the conduction between the opposite electrodes 47, 48, is assigned not to conductors having a definite geometry, such as the cells 4 or the threads 26, but to conductive fibres 46 irregularly scattered in portions 44 mutually insulated of non-conductive fabric.

From an examination of the features of the filters realized according to the present invention, the advantages they allow to attain are obvious.

First of all, the conductive portions (4; 26; 44) of the filtering members (3; 21; 43) are mutually insulated. This enables to obtain a selective and cyclic heating of the portions, with the advantage of reducing the electric power used and keeping under control the temperature of the filtering elements (3; 21; 43), without any risk of clogging or of destruction due to over-heating. Further, the heating of the residues takes place through conduction, that is through direct contact between the residues themselves and the conductive portions (4; 26; 44), which enables to exploit the most of the power supplied for the starting of the combustion, without great losses due to convection. Lastly, the filtering fabric elements (21; 43), thanks to their deformability, are particularly resistant to thermal shocks produced due to the sudden temperature variations during the heating and the cooling of the conductive portions (26; 44). The ceramic filtering members 3 as well can have a good resistance to thermal shocks, since they are subdivided in a plurality of cells 4 having reduced dimensions and being mutually thermally insulated.

In this connection, the fibres used are suitably subjected to pre-treatments apt to avoid the embrittlement and/or the possible breakage due to phase transformation or anyway to other phenomena produced by thermal shocks. The pre-treatments can be of chemical and/or physical nature, and depending on the type of fibre used said treatments consist in the introduction or extraction of ions through diffusion in the material of the fibre.

It is then obvious that to the filters 1, 35, 50 described can be introduced changes or variations, without departing from the scope of the present invention. In particular, the shape, the arrangement and the composition of the conductive portions (4; 26; 44) and of the relative insulating portions (12; 27; 45) can change. In the fabric 43, said insulating portions (45) can also be omitted, since the preferential orientation of the conductive fibres 46 establishes paths having a relatively reduced resistance in the traverse direction to the electrodes 47, 48, while the resistance increases indefinitely moving away from said paths; therefore, supplying only one electrode 47, the electric conduction, and so the heating, is obtained substantially in the portion 44 facing said electrode 47, while the surrounding portions behave substantially as insulators.

The filtering member can be produced with a combination of ceramic fabrics, felts or boards. For instance, the filtering member can comprise a series of stratified felt members; in particular, the single layers of the filtering member can be provided with pores having a geometric distribution, different dimensions and shapes, and arranged according to a porosity gradient. The electrification of the various elements can be carried out introducing in such elements electrically conductive fibres or threads. This solution enables to reduce the effect of the thermal shocks, in that the thermal conductivity is increased.

It can further be fixed upon a sliding element substantially arranged on a central plane of an inner chamber of the filter, in this case suitably formed with a quadrangular cross-section, and which can readily be introduced and extracted from the outer casing of the filter.

It is possible to change the logic of the control of the exchange 16, that can control the switches 15 in response to signals received from the user and/or from process sensors (for instange temperature or pressure sensors) arranged inside or outside the filter; the electric current supplying the conductive portions (4; 26; 44) can be modulated according to the temperature levels established in the filter.

Means for the introduction of air into the filter can be provided, in order to assure a sufficient partial pressure of oxygen in the exhaust gases and so a complete combustion of the residues.

At last catalysing additives can be provided suited to aid and optimize the combustion of the solid unburned particles. In particular said additives can suitably comprise a mixture of one or more metal-oxides, for instance $CuO$, $Cu_2O$, $MnO_2$, $Mn_3O_4$, $PbO$, $CeO_2$ or the respective oxygenated salts, for instance $Cu(NO_3)_2$, $CuSO_4$, and of one or more chlorides of an alkaline or alkaline-earth metal for instance $NaCl$, $KCl$, $LiCl$, $CuCl$, $CuCl_2$, $MgCl_2$, $BaCl_2$, possibly also in the hydrated form; preterably said mixture comprises $CuO$ and $NaCl$. Said mixture can be in a solid form (powder) or in the form of a solution in water or other solvent, and is deposited on the filtering member in the more convenient manner, such as insufflation, spraying or immersion.

We claim:

1. A regenerable filter for the exhaust gases of an internal-combustion engine, of the type comprising: an outer casing provided with at least an inlet duct and at least an outlet duct, apt to be placed in series with an exhaust pipe of said engine; filtering means housed into said outer casing and apt to intercept the residual combustion products in said exhaust gases; electric heating means apt to rise said residual combustion products to a temperature sufficient to start their combustion; and control means for electrically supplying said electric heating means; wherein said filtering means (21, 43) is formed of a filtering fabric; said electric heating means including a set of conductive fibers (26, 46) of electrically conductive material inserted in said filtering fabric; elongated insulating elements (27, 45) being provided to define a plurality of elongated portions (26, 44) of said filtering fabric insulated from one another; said portions (26, 44) being connected to said control means (15, 16) as to be electrically supplied in a selective and cyclic manner.

2. A filter as claimed in claim 1, characterized in that said conductive fibers (26) are in the form of transversal conductive threads (26) woven with longitudinal non-conductive threads (25) to form a woven thread (24)

representing said filtering fabric, said insulating elements being formed of transversal non-conductive threads (27) also woven with said longitudinal threads (25) and alternate with said conductive threads (26, said portions comprising groups of said conductive threads (26) electrically connected in parallel to one another.

3. A filter as claimed in claim 2, characterized in that said conductive threads (26) are metallic.

4. A filter as claimed in claim 2, characterized in that said conductive threads (26) are of conductive ceramic material.

5. A filter as claimed in claim 4, characterized in that said conductive threads (26) are of non-conductive ceramic material plated with a conductive material.

6. A filter as claimed in claim 2, characterized in that said longitudinal threads (26, 27) comprise a plurality of microthreads.

7. A filter as claimed in claim 1, characterized in that said conductive fibres (46) are dispersed in a non-conductive material of said filtering fabric.

8. A filter as claimed in claim 7, characterized in that said non-conductive material comprises a ceramic fabric.

9. A filter as claimed in claim 7, characterized in that said non-conductive material comprises a ceramic felt.

10. A filter as claimed in claim 7, characterized in that said non-conductive material comprises a plurality of felt layers superimposed and having porosities progressively differing.

11. A filter as claimed in claim 7, characterized in that said non-conductive material comprises a ceramic based paper.

12. A filter as claimed in claim 1, characterized in that said fabric (21; 43) is arranged inside an annular chamber (38) of said filter (35) according to a closed polygonal line, the corners of which are angularly equidistant and are alternatively fixed to an inner wall (37) and an outer wall (36) of said annular chamber (38).

13. A filter as claimed in claim 1, characterized in that said fabric (21) is pleated and fixed on a support element (51).

14. A filter as claimed in claim 13, characterized in that said support element (51) is spiral wound.

15. A filter as claimed in claim 13, characterized in that said support element is a slide arranged substantially on a central plane of an inner chamber of said filter.

16. A filter as claimed in claim 1, characterized in that it comprises starting means for the combustion scattered on said filtering means (3; 21; 43).

17. A filter as claimed in claim 16, characterized in that said combustion starting means comprise a mixture of at least a metallic oxide and/or at least an oxygenated salt suited to produce said metallic oxide and at least a chloride of an alkaline or alkaline-earth metal.

18. A regenerable filter for the exhaust gases of an internal-combustion engine, of the type comprising: an outer casing provided with at least one inlet duct and one outlet duct, apt to be placed in series with the exhaust pipe of said engine; filtering means housed into said outercasing and formed of a set of pairs of cavities having walls made of porous material, each one of said cavities being provided with an open end and a closed end, one cavity of each pair being provided with its open end communicating with said inlet duct, and the other cavity of each pair being provided with its open end communicating with said outlet duct, whereby said porous material is apt to intercept the residual combustion products in said exhaust gases; electrical heating means apt to rise said residual combustion products to a temperature sufficient to start their combustion; and control means for electrically supplying said electric heating means; wherein: said porous material is electrically conductive, said heating means including said walls (5, 6); said filtering means are formed by a plurality of elongated prismatic honey-comb cells (4) each one including at least one pair of said cavities (7), said plurality of cells (4) is arranged in a reticulate structure (12) defined by two orders of intersecting flat walls (13) made of non-conductive material to insulate said cells from each other; and the two ends (9, 10) of said cavities (7) in each cell (4) is electrically connected to said control means (15, 16) to be electrically supplied in a selective and cyclical manner.

19. A filter as claimed in claim 18, wherein each one of said cells (4) is provided with outer conductive walls (5) and is divided by longitudinal inner conductive walls (6), said outer walls (5) and said inner walls (6) constituting the walls of a group of at least two pairs of said cavities (7), and wherein said cells (4) and said cavities (7) have a polygonal cross-section.

20. A filter as claimed in claim 18, wherein said electrically conductive material is scattered with a mixture of at least one metallic oxide and/or one oxygenerated salt suited to produce said metallic oxide and of at least a chloride of an alkaline or alkaline-earth metal.

* * * * *